United States Patent [19]

Schaefer et al.

[11] 4,200,669

[45] Apr. 29, 1980

[54] LASER SPRAYING

[75] Inventors: Robert J. Schaefer, Springfield; Jack D. Ayers, Oakton, both of Va.

[73] Assignee: The United States of America as represented by the Secretary of the Navy, Washington, D.C.

[21] Appl. No.: 962,855

[22] Filed: Nov. 22, 1978

[51] Int. Cl.[2] ..... B05D 3/06

[52] U.S. Cl. ..... 427/53.1; 204/DIG. 11; 219/121 L; 427/423

[58] Field of Search ..... 427/53, 34, 423, 42; 219/121 L, 121 LM; 204/DIG. 11

[56] References Cited

U.S. PATENT DOCUMENTS

| | | | |
|---|---|---|---|
| T967,009 | 2/1978 | Gale | 427/53 |
| 3,310,423 | 3/1969 | Ingham | 427/53 |
| 3,872,279 | 3/1975 | Fairbairn | 219/121 L |
| 3,947,653 | 3/1976 | Fairbairn | 219/121 LM |
| 3,947,654 | 3/1976 | Fairbairn | 219/121 LM |
| 4,004,042 | 1/1977 | Fairbairn | 427/53 |
| 4,048,459 | 9/1977 | Earle | 219/121 LM |
| 4,091,256 | 5/1978 | Friichtenicht | 219/121 L |
| 4,125,926 | 11/1978 | Gale et al. | 427/53 |

OTHER PUBLICATIONS

*Encyclopaedic Dictionary of Physics*, Ed. Thewlis Pergamon Press, New York, 1962, pp. 243, 275, 276.

*Primary Examiner*—John H. Newsome
*Attorney, Agent, or Firm*—R. S. Sciascia; Philip Schneider; Thomas McDonnell

[57] ABSTRACT

A method and apparatus for spraying a surface which comprises: introducing into a laser beam, a powder with a vapor pressure from $10^{-2}$ to $10^{-1}$ atm. in excess of the ambient pressure at a temperature up to about 500° C. above the melting point thereof and with a heat-absorption coefficient from 0.2 to 1; and passing the laser beam over said surface. Since the method and apparatus can coat or alloy or dope a surface, a wide variety of protective coatings can be fabricated.

16 Claims, 4 Drawing Figures

LASER SPRAYING

BACKGROUND OF THE INVENTION

The present invention pertains generally to a method and apparatus for surface modification and in particular to a method and apparatus for spraying a surface.

Surface-property modifications obtained by spraying a surface include alloying the crystalline surface layer to improve chemical and mechanical properties, alloying the crystalline surface layer to produce an amorphous surface layer by a rapid self-quenching of the bulk crystalline metal, injecting powder particles of limited solubility into a melted surface layer to produce a dispersion of particles in the surface which improves the abrasion resistance of the material, and applying a molten powder to an unmelted surface to produce a coating with a chemistry and properties distinctly different from the bulk metal.

Alloying the crystalline surface layer is accomplished by a chemical diffusion at an elevated temperature or a melt of the surface layer. Examples of chemical diffusion are nitridation, carburization, and aluminidation. The disadvantages of both chemical diffusion and melting are a possible degradation of bulk properties due to subjecting the entire sample to a high temperature for a prolonged time, a slow production, and a high energy requirement.

The second type of modification has been achieved by weld cladding, laser surface cladding and laser surface glazing. Weld cladding comprises adding material from a consumable welding rod to a surface, thus coating the surface with the welding rod material, and is only suited for production of thick coatings. Laser surface cladding proceeds by applying a powder to a surface and then melting it by laser light. It is essentially a two-step process and suffers from the disadvantages of all multi-step processes. Laser surface glazing modifies a surface by melting and rapidly quenching a metal with a translating laser beam. This process is suited for the formation of an amorphous structure when the bulk chemistry is appropriate.

Injecting powder particles of limited solubility into a melted surface layer as a means for improving abrasion resistance has not been successful. Failures result from present techniques because they have a lower energy density at the surface and require excessive heating times to melt the surface. The generalized and long heating causes too much of the surface to melt for an even distribution of injected particles.

The application of a molten powder to an unmelted surface to produce a coating is generally achieved by plasma spraying which comprises propelling particles to a surface by means of a high-temperature plasma generated by R.F. excitation, the particles being melted by the plasma and impinging on the surface to form a coating. One example of plasma spraying is disclosed in U.S. Pat. No. 3,872,279 to Thomas E. Fairbain whereby a R.F. energy stream heats a powder as it is propelled towards a surface by a stream of inert gas. Surrounding the R.F. energy stream is an annular ring of inert gas which limits the scattering of the beam. A laser beam is focused down this ring of gas and is used to heat the substrate. Flame spraying is sometimes used and it proceeds by introducing a powder into an oxygen-combustible gas torch which fuses and propels the powder to a surface. The major disadvantages of coatings obtained by flame spraying or plasma spraying are the porosity of the coatings, the weakness of the bond due to a lack of wetting of the surface, entrapment of gases in the coating, reaction of the carrier gas with the powder and substrate, and contamination of the coating with material eroded from the electrode producing the plasma.

SUMMARY OF THE INVENTION

It is, therefore, an object of this invention to provide a method and apparatus which is suitable for alloying a surface layer, or altering a surface layer, by quickly heating and cooling, or injecting particles into a surface layer, or applying molten particles to a solid surface.

Another object of this invention is to eliminate the need to heat an entire body at a high temperature for a prolonged time in order to obtain an alloyed surface.

A further object of this invention is to apply a molten coating to a solid surface in such a manner that the coating upon solidification is strong and non-porous, has an exceptional bond to the surface, and is free of contamination originating from the process. .

These and other objects are achieved by introducing, into a laser beam, a powder having a heat absorbtivity such that the powder particles reach at least their melting point at most $10^{-2}$ seconds after entry and/or a vapor pressure which is $10^{-2}$ to $10^{-1}$ atmosphere greater than the ambient pressure.

DETAILED DESCRIPTION OF THE INVENTION

Figure 1:
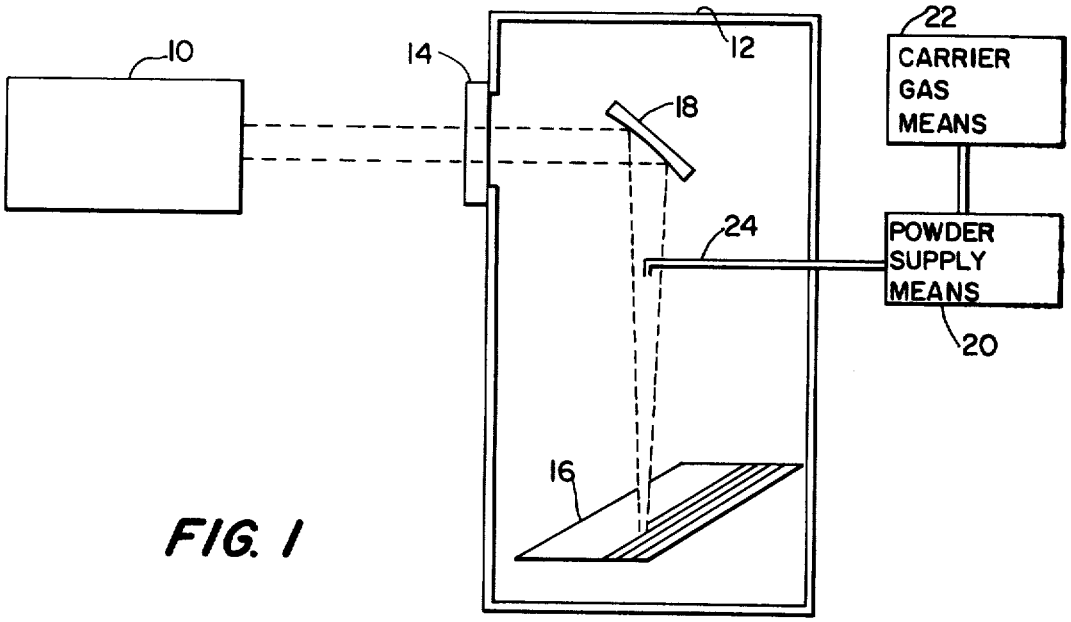
FIG. 1 is an illustration of an embodiment of a laser spraying apparatus according to the present invention.

The apparatus in FIG. 1 is an illustration of a basic arrangement for the practice of the invention. A laser 10 projects its beam into a chamber 12 through a window 14. If a special atmosphere, e.g., a vacuum or an inert gas, is not needed, then the chamber can be eliminated. The laser light is directed on a surface 16 by reflection from mirror 18, which can be flat or concave. If the entering beam is parallel, a flat mirror would give a parallel beam, while a concave mirror would produce a converging beam. In most instances, the converging beam is preferred on account of the increased energy density at the surface of the substrate. It is possible to directly focus the laser beam upon the surface, rather than to focus through the intermediation of a mirror.

The powder which is to be used to coat substrate 16 is transported from supply means 20 by a flow of carrier gas from a supply source 22 to the laser beam through nozzle 24. The carrier gas can be any inert gas. Gases which are inert to the greatest range of materials are the noble gases of helium, neon, and argon. Helium is preferred because it most strongly resists forming plasmas in the laser beam. It should be noted that the amount of gas needed to transport the powder is much less than the amount needed in other methods to propel the powders towards the surface since the supply gas does not have to accelerate the particles to a high velocity. This reduced need for gas is a significant advantage of the present invention over techniques requiring a gas to propel a coating powder to a substrate.

The apparatus modifies a surface through coating or alloying or doping by focusing a light beam from laser 10 onto a surface 16 as a stream of powder is fed into the beam through nozzle 24. The energy in the beam heats the powder particles to a partial or total melt and causes a rapid evaporation on the lighted side of the particles. The rapid evaporation propels the particles onto the surface where they coat, alloy, or imbed. By moving the laser beam across the surface, the entire surface can be so modified.

Figure 2:
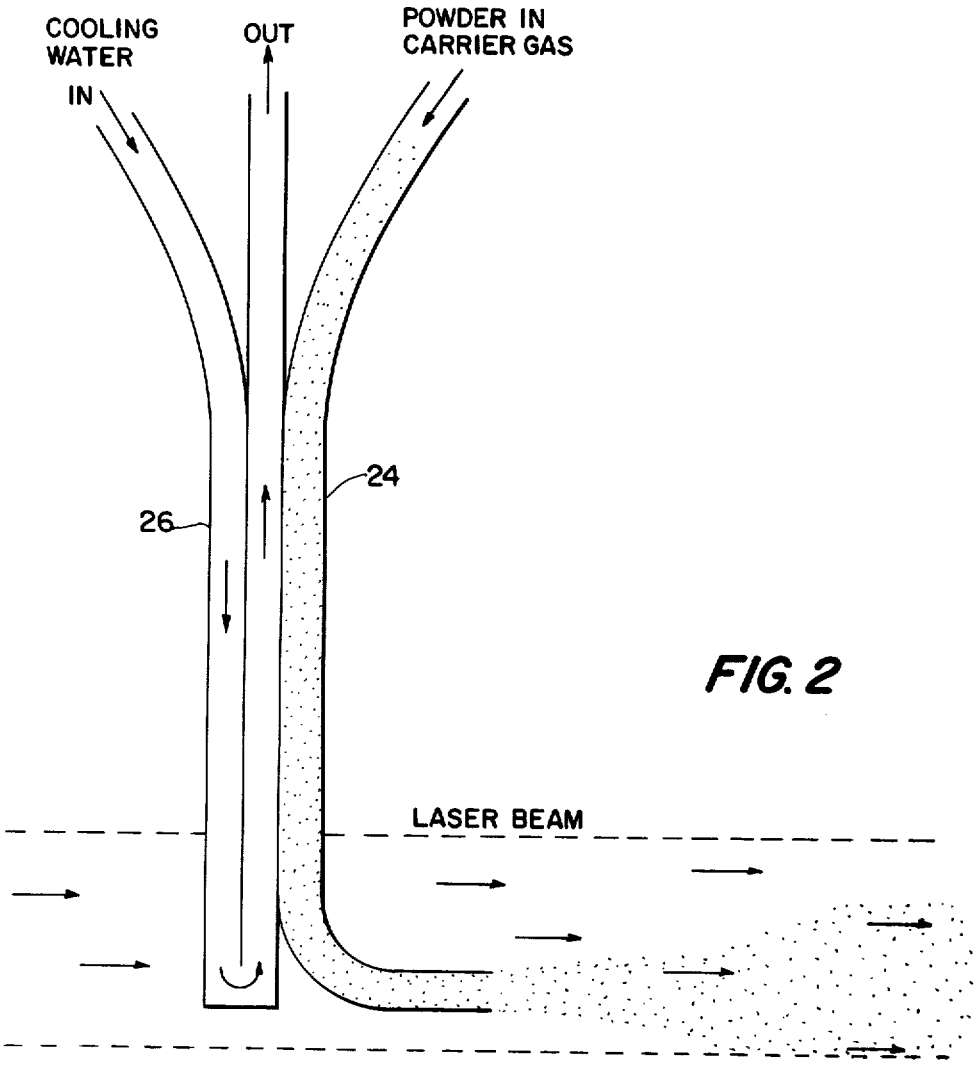
FIG. 2 is a more detailed illustration of a powder-feed nozzle used to introduce a powder into a laser beam.

FIG. 2 is a more detailed illustration of an embodiment of feed nozzle 24 with a thermal shield. In this embodiment a single-pass heat exchanger 26 is used as a thermal shield. The geometry of the heat exchanger is not material and the size is preferably no larger than is needed to properly shield the nozzle from the laser. The shield can be water-cooled and has a high reflectivity to the laser light, so that the shield and the feed nozzle remain cool. For a $CO_2$ laser, gold provides a 99 percent reflection. Without a thermal shield, the feed nozzle will become extremely hot and may melt or become clogged by powder particles. It is for these reasons that thermal shields are required for a long continuous use of the feed nozzle.

Figure 3:
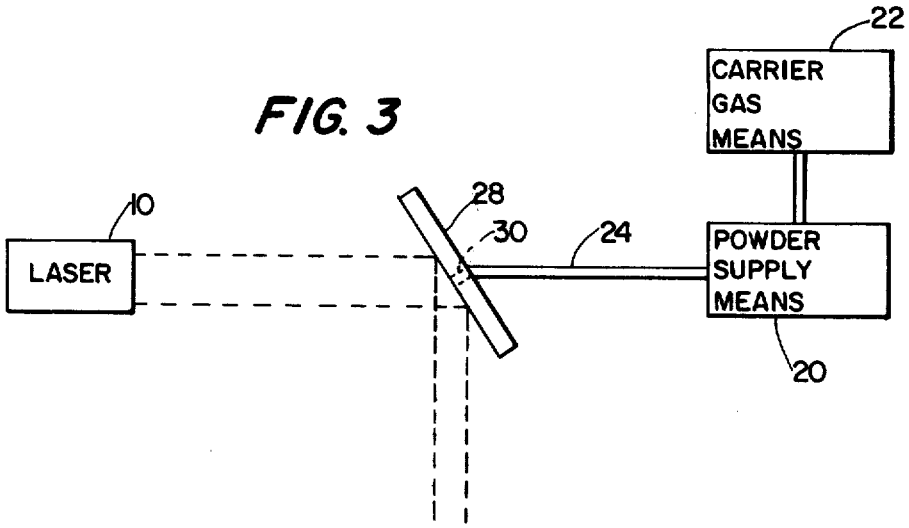
FIG. 3 is an illustration of a second embodiment of the invention in which a powder is introduced into the laser beam through the laser focusing mirror.

FIG. 3 illustrates an embodiment of the present invention wherein mirror 28 both focuses the laser beam and is the point of entry of the feed powder. Mirror 28 is simply a mirror with a hole 30 at a place approximately midway in the laser beam. It should be noted that the apparatus of the present invention does not require the laser beam to be focused downwardly on a surface. The surface can be at the same level or higher than the point of entry of the feed powder into the laser beam.

Since propulsion of the particles arises from the rapid evaporation on one side of the particles, the particles must possess certain properties for this phenomenon to occur. The vapor pressure of the particles must be from about $10^{-2}$ to about $10^{-1}$ atmospheres greater than the ambient pressure. Generally, this vapor pressure should be reached at a temperature from about the melting point of the powder particles to about five hundred degrees Celsius above the melting point. If the vapor pressure is too near the ambient pressure, the evaporation would be too slow to produce propulsion. On the other hand, a vapor pressure which is too high would cause the particles to vaporize too fast. If the vapor pressure equals the ambient pressure at a temperature less the melting point, the particle would sublimate. Sublimation is not generally advantageous in that the particle would arrive at the surface in a totally unmelted condition instead of the usually desired melted condition. An exception is the instance when it is desired to inject solid particles into a thin surface layer melted by the laser.

The second critical property of the particles is the coefficient of heat absorption which is defined by:

$$a = \frac{P_A}{\pi r^2 p}$$

wherein $P_A$ is the amount of power absorbed by a particle, r is the radius of the particle, and p is the power density of a laser beam. Values for the coefficient required to give a sufficient rate of heating for laser spraying are from 0.2 to 1.0. A sufficient rate of heating is one that raises the temperature of the particles to a temperature at which the vapor pressure of the particles exceeds the ambient pressure by about $10^{-2}$ to $10^{-1}$ atm in a period of time of not more than $10^{-2}$ second.

Example of coating materials suitable for the practice of the present invention are metal oxides such as $Al_2O_3$, $Cr_2O_3$, $Y_2O_3$, $TiO_2$, $ZrO_2$, $Ca_2O_3$, and mixtures thereof; nonmetal oxides such as $SiO_2$; metals of low-to-moderate density (sp. gr. $<10$) such as Al, Ti, Cr, Fe, Ni, Cu, Zr, Nb and alloys thereof; metal carbides such as SiC TiC, VC, $Cr_2C_3$, NbC, and mixtures thereof; cemented carbides which are metal carbides coated with a metal such as Co or one of the self-fluxing alloys to cause the carbide particles to adhere to one another; nitrides such as $Si_3N_4$; and boron.

The only other parameter of the particles which is of consequence is the diameter. The smallest possible diameter of the particles is the wavelength of the laser. In practice, the diameter of the particle cannot be so small that the particle completely evaporates before reaching the surface to be coated nor can it be so large that the rapid evaporation does not propel the particles or that the quality of the resulting coating is reduced. Experiments to date show the upper limit to be about 200 micrometers. Generally, for most applications, the diameter would be from 40 to 100 micrometers.

The particle density in the laser beam is such that the cross-sectional area of the particles in the beam does not exceed one-fourth of the narrowest cross-sectional area of the beam. This requirement can be expressed as the beam area-to-total particle cross-sectional area ratio. Thus the ratio cannot be less than 4:1 at any point along the path of the beam. If the ratio is less than this amount, an appreciable number of particles is not exposed to the laser light due to the blocking effects of other particles. Consequently, these particles fall out of the laser beam or travel along the beam without being sufficiently heated. Also too much of the surface is shaded. If the ratio is too high, the process is inefficient. Consequently, the preferred beam area-to-total particle cross-sectional area ratio is from 7:1 to 10:1 at the narrowest point of the laser beam.

The laser may be of any type, continuous wave or pulsed, and operate at any wavelength. It is preferred to operate the laser at the wavelength which gives maximum energy absorption by the particles. For most materials, an effective wavelength of the laser is about 10.6 microns which is the wavelength of a $CO_2$ laser. The beam may be either parallel or focused, i.e., converging. A converging beam provides a greater energy density at the surface. This configuration would, of course, be preferred for those applications where a maximum heating of the surface is needed. Particle losses from the laser beam are minimized by a parabolic energy distribution across the laser beam, with a central minimum and a higher energy density at the perimeter. The maximum perimeter energy-to-center energy ratio is about 2.5:1. The preferred ratio is from 1.5:1 to 2.0:1. It should be noted that a flat energy distribution is acceptable for the practice of this invention.

The energy density of the laser beam depends on the application and the configuration of the beam. It cannot be so large as to totally vaporize the particles or overheat the surface to be coated. On the other hand, it must be sufficient to rapidly vaporize the exposed surface of the particles and to heat the surface to be coated, if that is desired. It has been determined that the energy density of the beam must be at least about one kW/sq. cm. at the point of entry of the powder. The preferred energy density depends on the application.

The energy density affects the velocity of the particles. Higher velocities lower the number of particles that fall out of the laser beam, cause the particles to flatten upon impact with the surfaces, and can cause the particles to penetrate the surface. Generally, the velocity is about 5 to 6 m/sec, but it can be as high as about 100 m/sec. and as low as 1 to 2 m/sec. If vaporization is becoming generalized on the surface at the power density required for the desired rate of vaporization, a pulsed laser would be preferred. Pulsed lasers minimize heat conduction to the unlighted portions of the particle surface and thus would localize, to a greater degree, the vaporization on the lighted surface. A pulse time from about 5 to about 40 percent of the thermal relaxation time of the powder particles is preferred and approximately 1/10 of the thermal relaxation time is most preferred.

The ambient conditions are not too important. The ambient temperature has little effect on the process, provided the temperature is not enough to melt the powder. It is preferred that the ambient pressure be low. A vacuum increases the particle speeds and reduces powder losses from the laser beam by convection. The preferred vacuum is from 1/1000 to 1/10 atmosphere. It is essential that the atmosphere not be reactive with the particles or the substrate.

The point of entry of the powder into the laser beam is at such distance from the surface that the particles reach the temperature necessary for the vaporization which propels them. The preferred distance is the shortest distance for the obvious reasons of minimizing the vaporization losses of the particles and losses of particles from the laser beam. Generally, the particles travel from about 30 to 110 cm.

In the practice of this invention, the substrate may be heated or cooled prior to coating. A warm substrate would increase the bonding strength. It is, of course, possible to adjust the particle density and the energy density of the laser beam so that the laser beam itself warms the substrate. A cooled substrate would cause the molten particles to cool quickly and thereby produce an amorphous surface.

To better illustrate the practice of this invention, the following examples are given. It is understood that these examples are given by way of illustration and are not meant to limit the disclosure or the claims to follow in any manner.

EXAMPLE I

VELOCITY OF ALUMINUM OXIDE PARTICLES IN AIR

Figure 4:
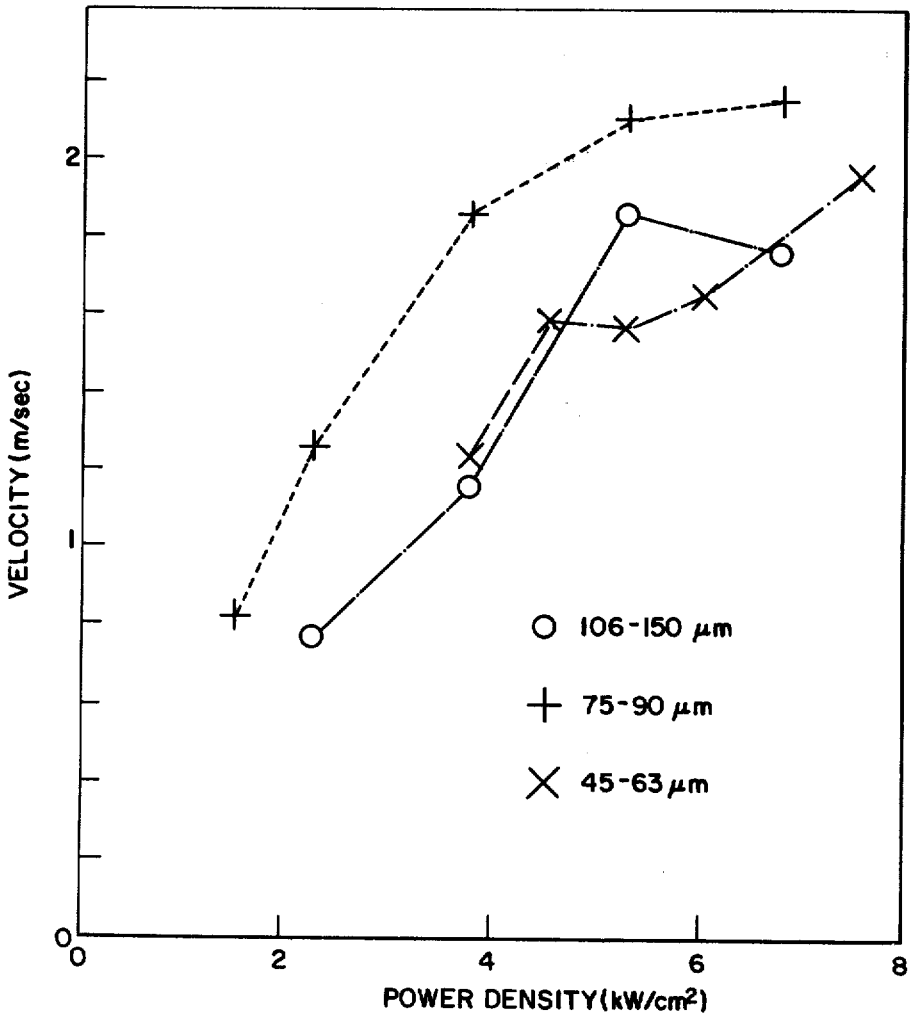
FIG. 4 graphically illustrates the variation of particle velocity with laser-beam power density for three powder sizes.

Experiments have been carried out to measure the velocity at which aluminum oxide particles are propelled through air by laser beams. Size-sorted powder particles were used; a "fine" size (45 to 63 μm diameter), a "medium" size (75 to 90 μm diameter) and a "coarse" size (106–150 μm diameter). The particles were injected into horizontal $CO_2$- laser beams of various power densities and their velocities were measured by a photographic recording system at a point 15 cm from the nozzle with the results shown in FIG. 4.

The recorded velocities represent the average of the four fastest particles seen at each power level and thus represent the particles which best remained within the uniform part of the beam. Although there is considerable scatter, it is evident that the velocity increases with increasing power density. There is no strong dependence of velocity on powder size, but there is an indication that velocities are at a maximum for particles of "medium" size.

The sizeable velocities obtained in air with such low power densities indicate that these particles can reach extremely high velocities at higher power densities or at reduced pressures.

EXAMPLE II

PHYSICAL STATE OF THE PARTICLES IN BEAM

Particles were caused to fall out of a laser beam with a power density of 2kW/cm$^2$. These particles were collected and examined under a microscope. Before entry into the laser beam, they had an angular surface and shape. Afterwards, their surfaces were extremely smooth and their shape was spherical. These results demonstrate that the particles were melted in the beam.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method of spraying a surface which comprises:

selecting a powder with a vapor pressure from $10^{-2}$ to $10^{-1}$ atmosphere in excess of the ambient pressure at a temperature up to about 500° C. above the melting point thereof and with a heat absorption coefficient from 0.2 to 1.0;

introducing said powder into a laser beam with a wavelength smaller than the diameter of said powder and a power density of at least one kW/cm$^2$ at the point of entry; and directing said laser beam on the surface to be sprayed.

2. The method of claim 1 wherein the diameter of said powder is about 200 micrometers or less and the vapor pressure of the powder is $10^{-2}$ to $10^{-1}$ atmospheres at a temperature from the melting point to about 500° C. above the melting point of said powder.

3. The method of claim 1 wherein said powder is introduced in an amount such that the smallest beam area-to-total particle area ratio is not less than 4:1.

4. The method of claim 3 wherein said ratio is from 7:1 to 10:1.

5. The method of claim 1 wherein said laser beam is not continuous.

6. The method of claim 5 wherein the duration of said laser beam is about one tenth of the thermal relaxation time of said powder.

7. The method of claim 5 wherein the maximum perimeter energy-to-center energy ratio is greater than 1:1 but less than 2.5:1.

8. The method of claim 7 wherein said maximum perimeter energy-to-center energy ratio is from 1.5:1 to 2.0:1.

9. The method of claim 4 wherein said laser beam is pulsed, the pulses having a duration of about one tenth of the thermal relaxation time of said powder and the beam having a maximum perimeter energy-to-center energy ratio from 1.5:1 to 2.0:1.

10. The method of claim 9 wherein the ambient pressure of the process is reduced below atmospheric pressure and the vapor pressure of said powder is $10^{-2}$ to $10^{-1}$ atmospheres greater than the ambient pressure at a temperature from the melting point to about 500° C. above the melting point of said powder.

11. The method of claim 10 wherein said ambient pressure is from $10^{-3}$ to $10^{-1}$ atmosphere and the average diameter of said powder is from about 40 to 100 microns.

12. A system for modifying a surface by spraying which comprises:

a laser for projecting a beam with a power density and wavelength of such magnitude to vaporize powder particles on the side exposed to said laser sufficiently rapidly to propel said particles to said surface at such velocity as is required to effect the intended modification, said powder having a vapor pressure from $10^{-2}$ to $10^{-1}$ atmosphere greater than the ambient pressure at a temperature up to about 500° C. above the melting point thereof;

a source of supply for said powder;

means for transporting said powder to said laser beam from said supply; and means for introducing said powder into said laser beam from said transporting means at a distance from said surface.

13. The system of claim 12 which further comprises:

a chamber wherein said surface is located; and means for introducing said laser beam into said chamber.

14. The system of claim 12, wherein:

said means for introducing said powder into a beam from said laser further comprises a thermal shielding means.

15. The system of claim 13 which further comprises means for directing said beam on said surface.

16. The system of claim 15 wherein said means for introducing said powder into said beam and said means for directing said beam on said surface comprise a single means.

* * * * *